United States Patent [19]

Kimura et al.

[11] Patent Number: 4,581,604

[45] Date of Patent: Apr. 8, 1986

[54] ATMOSPHERIC ABNORMALITY DETECTION ALARM SYSTEM

[75] Inventors: Tetsuo Kimura, Tokyo; Seiichi Tanaka, Chiba; Takashi Suzuki, Tokyo, all of Japan

[73] Assignee: Nittan Company, Limited, Tokyo, Japan

[21] Appl. No.: 546,109

[22] Filed: Oct. 27, 1983

[30] Foreign Application Priority Data

Oct. 27, 1982 [JP] Japan ..... 57-187494

[51] Int. Cl.[4] ..... G08B 19/00

[52] U.S. Cl. ..... 340/521; 340/505; 340/518; 340/525; 340/825.06; 340/870.16; 340/870.21

[58] Field of Search ..... 340/521, 518, 505, 506, 340/503, 504, 500, 501, 531, 534, 825.06–825.13, 825.21, 825.54, 825.52, 870.16, 870.21; 179/5 R

[56] References Cited

U.S. PATENT DOCUMENTS 3,516,063 6/1970 Arkin et al. ..... 340/518
4,148,021 4/1979 Watanabe ..... 340/505

*Primary Examiner*—Donnie L. Crosland
*Attorney, Agent, or Firm*—Hill, Van Santen, Steadman & Simpson

[57] ABSTRACT

An atmospheric abnormality detection system includes a command discriminator and a display/alarm circuit in each sensor terminal. When the command discriminator receives a coincidence signal from an address comparator, the command discriminator causes an A/D converter to convert an analog sensor output to a digital signal as response data. When an abnormal state display command is transmitted from a main unit to the command discriminator, the command discriminator causes the display/alarm circuit to display information indicating the abnormal state and/or generate an audible alarm.

6 Claims, 3 Drawing Figures

ATMOSPHERIC ABNORMALITY DETECTION ALARM SYSTEM

BACKGROUND OF THE INVENTION

The present invention relates to an alarm system. More particularly, the present invention relates to an atmospheric abnormality detection alarm system wherein a plurality of sensor terminals are separately connected to a single transmission line and are cyclically accessed by a main unit (central receiver). An accessed sensor terminal converts an analog signal (indicating smoke concentration, temperature, gas concentration or the like) to a digital signal which is then transmitted to the main unit. The main unit processes the digital signal to detect any atmospheric abnormality (e.g., fire or gas leakage) at this sensor terminal or malfunctioning of the sensor itself, and then displays the detected contents and generates an audible alarm.

In the conventional system of this type, when an abnormality is detected at a sensor terminal, the main unit indicates this sensor terminal by its address and generates an audible alarm in accordance with the alarm content. For example, maintenance personnel are made aware of the occurrence of a fire and its location. However, in practice, when maintenance personnel reach the detected site, it is very difficult to confirm the exact location where fire has broken out. This may disable early fire fighting, resulting in a big disaster.

SUMMARY OF THE INVENTION

The present invention eliminates the conventional drawback described above, and has for its object to provide an atmospheric abnormality detection alarm system wherein occurrence of an abnormality is indicated at a sensor terminal installed at the location of the detected fire or in the vicinity thereof (entrance of a room), so that maintenance personnel or foremen can readily confirm the exact location where fire has broken out.

In order to achieve the above object of the present invention, there is provided an atmospheric abnormality detection alarm system comprising a main unit connected to a transmission line for cyclically generating an address signal and an abnormal state display command signal. A plurality of sensor terminals are separately connected to the transmission line. Each of the plurality of sensor terminals are arranged to convert an analog output signal corresponding to one of the parameters smoke concentration, temperature and gas concentration to digital data when each sensor terminal is accessed by the main unit in response to a corresponding address signal. The digital data is then transmitted as response data to the main unit. Each sensor terminal has a command discriminator for receiving and deciphering the abnormal state display command transmitted from the main unit through the transmission line and a display/alarm circuit for displaying information indicating an atmospheric abnormality in response to an output signal from said command discriminator.

DETAILED DESCRIPTION OF THE PREFERRED EMBODIMENT

Figure 1:
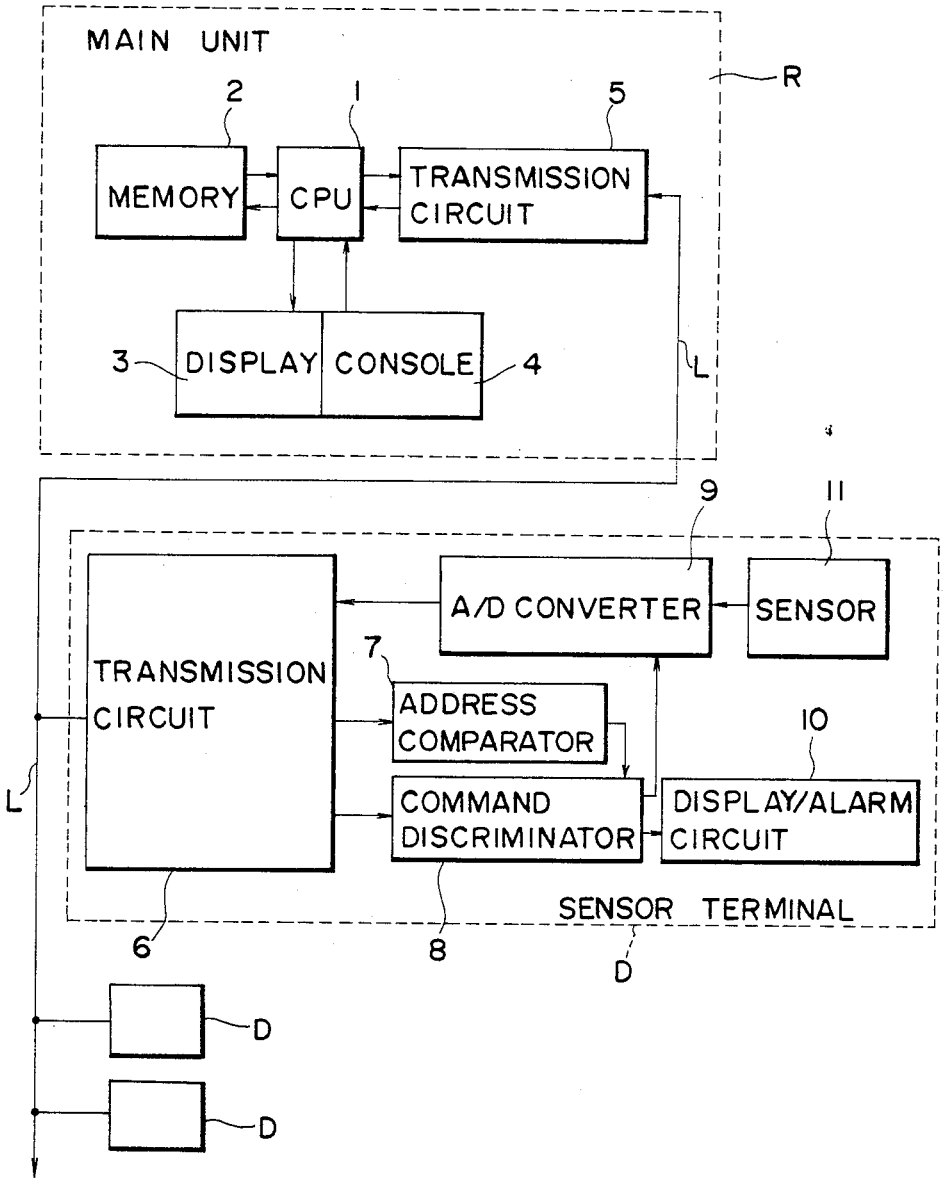
FIG. 1 is a block diagram of an atmospheric abnormality detection alarm system according to a preferred embodiment of the present invention.

An atmospheric abnormality detection alarm system according to an embodiment of the present invention will be first described in detail with reference to FIG. 1.

A main unit (central receiver) R has a central processing unit (to be referred to as a CPU hereinafter) 1, a memory 2, a display 3, a console 4, a transmission circuit 5, and so on. A program stored in the memory 2 is executed by the CPU 1. The CPU 1 supplies address and command signals for a sensor terminal D to the transmission circuit 5. The transmission circuit 5 converts these signals to serial data in a transmission format suitable for a transmission line L. A transmission circuit 6 in the sensor terminal D converts the serial data to parallel data having predetermined levels. In each of the sensor terminals D, an address comparator 7 compares the address represented by the transmitted address signal with an address assigned thereto. When these addresses coincide, a command discriminator 8 deciphers the command data. When the command data indicates data transmission, the command discriminator 8 causes an A/D converter 9 to transmit digital data onto the transmission line L through the transmission circuit 6. However, when the command data indicates data display, the command discriminator 8 causes a display/alarm circuit 10 to perform display in a predetermined mode. The display modes include a fire display mode, a breakdown display mode and so on. The fire display mode may be accompanied by an audible alarm. The A/D converter 9 receives an analog output signal from a sensor 11 and converts it to corresponding digital data. This digital data is transmitted onto the transmission line L through the transmission circuit 6 in response to the output from the command discriminator 8.

The operation of the atmospheric abnormality detection alarm system of the embodiment described above will now be described.

In normal operation, the main unit R cyclically generates an address signal for each sensor terminal D and a data transmission command signal therefor. The response data from the sensor terminal D is generally processed in accordance with a program stored in the memory 2. For example, the response data from the sensor terminal D is compared with reference data. If the response data is greater than the reference data, the CPU 1 determines that a fire has broken out and causes the display 3 to display the terminal number of the corresponding sensor terminal D. At the same time, an audible fire alarm is generated, and the CPU 1 transmits a fire display command to the corresponding sensor terminal D. Upon reception of the fire display command, the corresponding command discriminator 8 deciphers the fire display command and causes the display/alarm circuit 10 to indicate the existence of the fire. When the CPU 1 completes the above operation, the CPU 1 cyclically accesses the remaining sensor terminals D. Maintenance personnel can identify the general location of the detected fire by means of the display 3, and go immediately to the location where the fire has supposedly broken out. They then look for the activated display/alarm circuit 10 to confirm the exact location where the fire has broken out, thereby performing proper and quick response. In this case, when an audible alarm is generated by the display/alarm circuit 10, maintenance personnel can readily find the exact location. The alarm display can be situated in front of the entrance of the room in which the corresponding sensor is installed, so that maintenance personnel can readily find the location of the display/alarm circuit 10. Furthermore, a fire display can also be accompanied by a sensor breakdown display. In this case, repair personnel can easily repair the broken sensor.

According to the atmospheric abnormality detection alarm system described above, the main unit can cyclically access the plurality of sensor terminals. When an atmospheric abnormality is detected by the main unit in accordance with the response data from a given sensor terminal, the main unit transmits a display command to the given sensor terminal. This sensor terminal causes the command discriminator to present the fire display at its display/alarm circuit 10. Therefore, maintenance personnel can easily and quickly find the exact location where fire has broken out immediately after they reach the general location of the detected fire.

The main unit in the preferred embodiment can be any one of a number of standard computers or personal computers presently on the market. The transmission circuit 6 is a standard prior art I/O device for serial-to-parallel data conversion. Similarly the address comparator 7, A/D converter 9, and sensor 11 are devices well known in this art. The display/alarm circuit 10 can, in the preferred embodiment constitute an alarm or flashing light activated by the command discriminator 8. The command discriminator 8 comprises the integrated circuit EWD 106 of Fuji Electronics Co., Ltd.

Figure 2A:
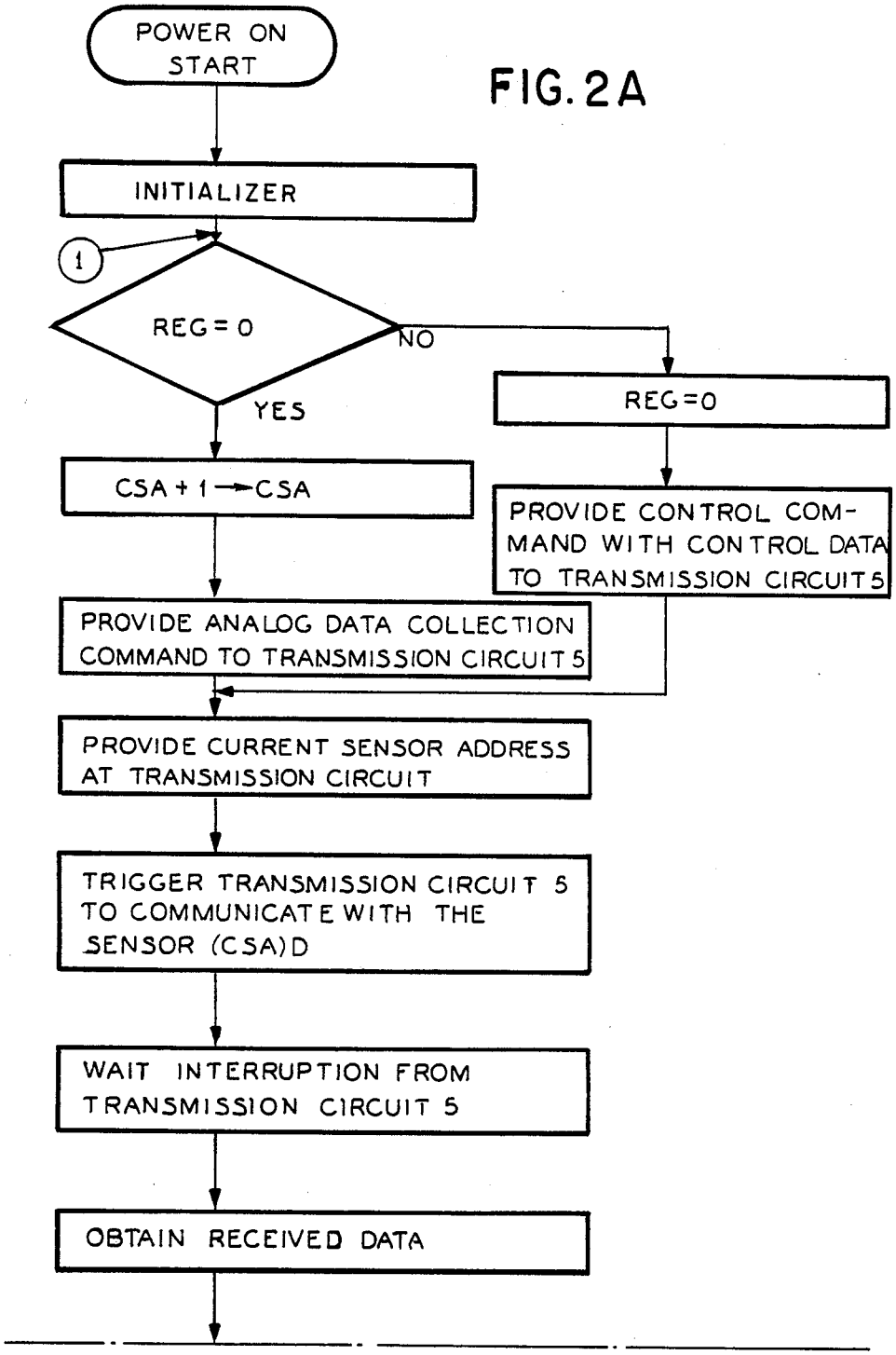
FIGS. 2A and 2B show a flow chart for the system of FIG. 1.
Figure 2B:
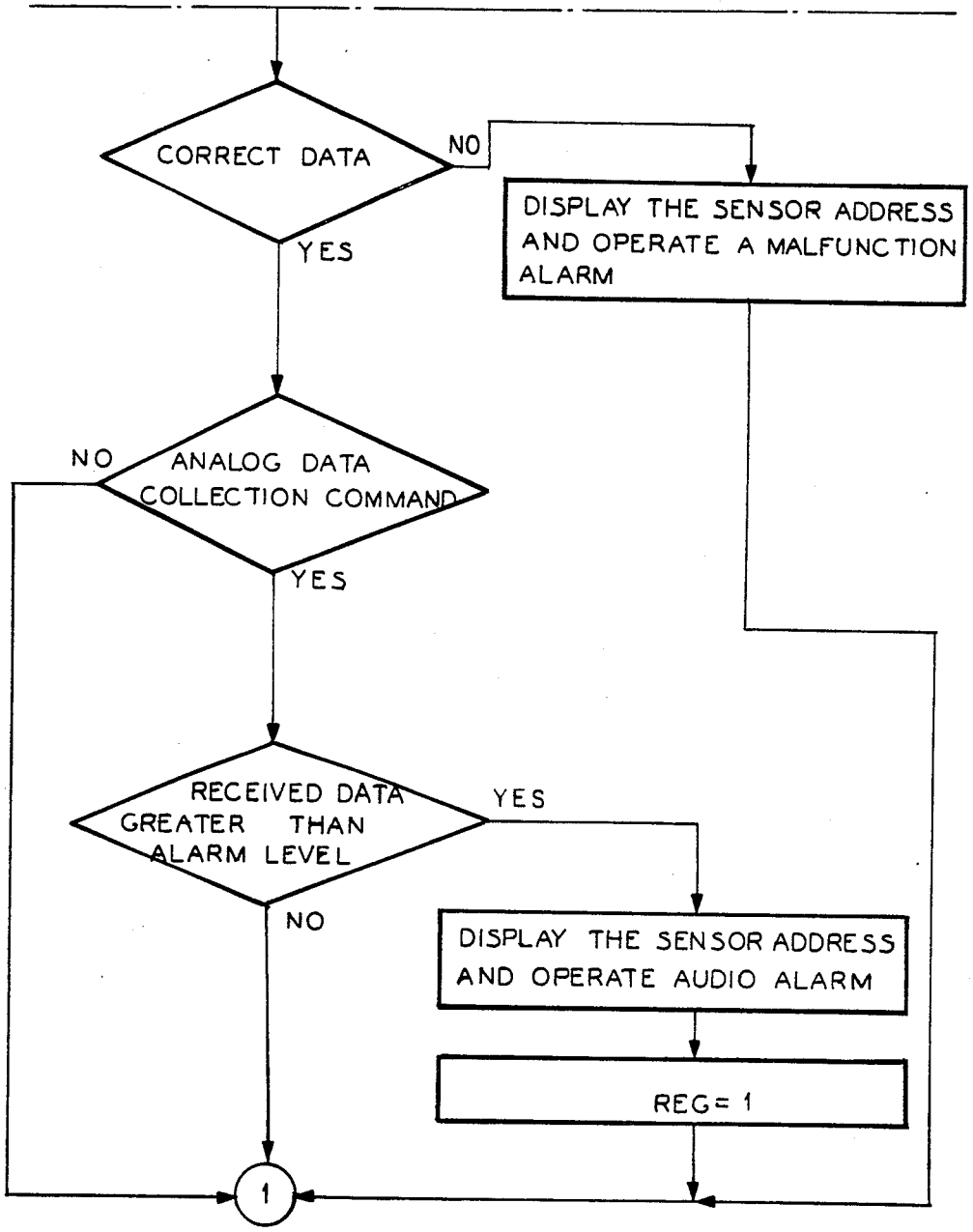

FIG. 2 illustrates a preferred embodiment of a flow chart for the system of FIG. 1.

As the system is supplied power, the CPU 1 on the main unit R executes a program. First of all, an initializer subroutine shown on the flow diagram is called. In the routine, some buffers are set to predetermined values and all I/O (input and output) interfaces for the transmission circuit 5 and a console 4 etc, are set to proper commands. Of course a display 3 and audio alarms are also reset.

A register buffer shown on the flow chart requests transmission of control data to a same sensor D which has been processed and determined to be in an abnormal condition. Therefore, if a sensor D detects a fire and the CPU recognizes the fire, the Reg buffer is set to a value other than zero, and the sensor D is again called by the main unit R to transmit control data for indicating an abnormal state at the sensor D. In this case, the transmission circuit 5 will be set for a control command with control data. If the Reg. buffer is zero, a CSA (current sensor address) buffer is counted up by one so that a new sensor which is assigned a next current sensor address (CSA) is called. Also a digitized analog data transmission command is provided to the transmission circuit 5.

Next, an address of a sensor to which it is intended to transmit, i.e. the address contained in the CSA buffer, is also provided to the transmission circuit 6. The CPU triggers the circuit 5 to transmit an address data and a command data to the sensor D via the transmission line L.

After that, the main unit R waits for an interruption from the transmission circuit 5. The interruption results from analog data being received from the sensor. When the transmission circuit 5 has received such analog data, the circuit 5 sends an interruption signal to the CPU 1. If the CPU 1 receives the signal, the CPU 1 picks up the analog data from the transmission circuit 5.

In general, the analog data has a parity bit. Therefore, the CPU 1 can check whether a communication between the main unit R and the sensor D has been successful. If the parity bit is not proper, the analog data probably is not correct. In this case, the main unit R must display the sensor address on a trouble indicator and trigger a trouble alarm.

If the data is correct, the CPU 1 examines an analog data collection command at this time. If an analog data collection command is not present, return to circle 1. If an analog data collection command is present, the received analog data is compared with a predetermined value, i.e. an alarm level. If the analog data is greater than the level, the main unit R displays an address of the sensor D or a number of a zone or group related to the sensor D, and triggers an alarm sounder. In order to communicate with the same sensor D by a control command, the Reg. buffer also must be set to a value other than zero and a control data buffer, which is not shown in the flow chart, is set to a proper control data to indicate a status of the sensor D.

Thereafter, the CPU 1 executes from 1 again. However, at this moment, the Reg. buffer is not zero so that the main unit R does not renew a content of the CSA buffer and sends a control command with control data to the transmission circuit 5 to communicate with the sensor D.

Although various minor changes and modifications might be proposed by those skilled in the art, it will be understood that we wish to include within the claims of the patent warranted hereon all such changes and modifications as reasonably come within our contribution to the art.

We claim as our invention:

1. An atmospheric abnormality detection alarm system comprising:

a plurality of sensor terminal means separately connected to a transmission line;

a main unit means connected to the transmission line for generating an address signal cyclically, and also an abnormal state display command signal when a received response data from a sensor terminal means is compared to a reference data and an abnormal state is determined, said main unit means having indicating means for indicating the sensor terminal means having the abnormal state in response to the comparison;

each of said plurality of sensor terminal means having a sensor means and having means for converting an analog output signal from the sensor means corresponding to one of the parameters smoke concentration, temperature, and gas concentration to digital data when each sensor terminal means is accessed by said main unit means in response to a corresponding address signal, and to transmit the digital data as said response data to said main unit means; and each sensor terminal means having a command discriminator means for receiving and deciphering the abnormal state display command transmitted from said main unit means through the transmission line and a display/alarm circuit means for displaying information indicating an atmospheric abnormality in response to an output signal from said command discriminator means.

2. A system according to claim 1 wherein said main unit means comprises: a memory means for storing a predetermined program; a central processing unit (CPU) means for executing the predetermined program; a display means for displaying information indicating the atmospheric abnormality in accordance with the response data received through said CPU means; a console means for allowing an operator to access a desired sensor terminal; and a transmission circuit means for transmitting the address signal and the abnormal state display command in a form of serial data and for receiving the response data.

3. A system according to claim 1 wherein each sensor terminal further comprises: an address comparator means for comparing an address of the address signal with an address assigned to said each sensor terminal means and for generating a coincidence signal to said command discriminator means when a coincidence between the addresses is established; an A/D converter means for converting the analog output signal to the digital signal as the response data when the output signal from said command discriminator means is supplied to said A/D converter means; a transmission circuit means for receiving the address signal and supplying the address signal to said address comparator means, for receiving the abnormal state display command and supplying the abnormal state display command to said command discriminator means, and for receiving the response data from said A/D converter means and transmitting the response data to said main unit means through the transmission line.

4. A system according to claim 1 wherein said display/alarm circuit means generates an audible alarm in response to the output signal from said command discriminator means.

5. A system according to claim 1 wherein said display alarm circuit means displays information indicating a sensor breakdown.

6. An atmospheric abnormality detection alarm system comprising:

a plurality of sensor terminal means separately connected to a transmission line;

a main unit means connected to the transmission line for generating an address signal cyclically, and also an abnormal state display command signal when a received response data is compared to a freely selectable reference data and an abnormal state is determined, said main unit means having indicating means for indicating the abnormal state in response to the comparison;

each of said plurality of sensor terminal means having an address comparator, a sensor means, and means for converting an analog output signal from the sensor means corresponding to one of the parameters smoke concentration, temperature, and gas concentration to digital data when each sensor terminal means is accessed by said main unit means in response to a corresponding address signal compared in said address comparator, and to transmit the digital data as said response data to said main unit means; and each sensor terminal means having a command discriminator means for receiving and deciphering the abnormal state display command transmitted from said main unit means through the transmission line and a display/alarm circuit means for displaying information indicating an atmospheric abnormality in response to an output signal from said command discriminator means responsive to an output from said address comparator.

* * * * *